US006675401B2

(12) United States Patent
Peterson et al.

(10) Patent No.: US 6,675,401 B2
(45) **Date of Patent: *Jan. 13, 2004**

(54) TRANSFER SEAT WITH EXTENDED TRANSFER PLATFORM

(76) Inventors: Glenn A. Peterson, 105 Lee Ct., Hendersonville, TN (US) 37075; Michelle J. Jones, 646 Albany Dr., Hermitage, TN (US) 37076

( * ) Notice: Subject to any disclaimer, the term of this patent is extended or adjusted under 35 U.S.C. 154(b) by 0 days.

This patent is subject to a terminal disclaimer.

(21) Appl. No.: 10/238,472

(22) Filed: Sep. 10, 2002

(65) Prior Publication Data

US 2003/0070220 A1 Apr. 17, 2003

Related U.S. Application Data

(63) Continuation of application No. 09/629,957, filed on Aug. 1, 2000, now Pat. No. 6,467,102.

(51) Int. Cl.[7] ..... A47K 11/06; A61G 7/02

(52) U.S. Cl. ..... 4/480; 4/483; 4/578.1; 4/604; 5/81.1 HS; 297/411.21

(58) Field of Search ..... 4/234, 235, 237, 4/578.1, 460, 480, 483, 604, 560.1; 5/81.1 HS; 297/411.21

(56) References Cited

U.S. PATENT DOCUMENTS

| | | | | |
|---|---|---|---|---|
| 1,428,627 | A | 9/1922 | Grabfelder | |
| 2,752,610 | A | 7/1956 | Mabrey | |
| 3,863,276 | A | 2/1975 | Agnew | |
| 4,287,619 | A | 9/1981 | Brewer | |
| 4,719,655 | A | 1/1988 | Dean | |
| 5,062,165 | A | 11/1991 | Kerr | |
| 5,373,591 | A | 12/1994 | Myers | |
| 5,384,920 | A | 1/1995 | Havens | |
| 5,526,541 | A | 6/1996 | Massey et al. | |
| 5,687,431 | A | 11/1997 | Garrett | |
| 5,822,809 | A | 10/1998 | Gallo | |
| 6,467,102 | B1 * | 10/2002 | Peterson et al. | 4/480 |

FOREIGN PATENT DOCUMENTS

DE 3607310 A1 3/1988

OTHER PUBLICATIONS

Invacare Manual: Wheelchair Products Catalog, pp. 10–12, 18–21, and 5 misc. pages from the 2000 Catalog.
Article regarding toilet seats (p. 19) from Ableware, Ind. Living from Maddak, Inc., Catalog # 0699, 1999.
Article regarding Transfer Boards (p. 36) from Northcoast Medical Catalog, 1999.

* cited by examiner

*Primary Examiner*—Tuan N. Nguyen
(74) *Attorney, Agent, or Firm*—Baker, Donelson, Bearman, Caldwell & Berkowitz; Donna Russell

(57) ABSTRACT

A combination of a chair-like device used by disabled persons, such as a bedside commode, and a seat having a transfer platform that extends laterally outward from a central seating portion of the seat. The extended transfer platform extends beyond the perimeter of the chair frame and at least partially overlaps a supporting surface of a bed or chair that is positioned adjacent to the commode seat. The seat with extended transfer platform thereby provides a continuous transfer surface between the commode or other chair-like device and the adjacent bed or chair.

15 Claims, 5 Drawing Sheets

(Prior Art)

TRANSFER SEAT WITH EXTENDED TRANSFER PLATFORM

This application is a continuation of and claims benefit of U.S. patent application Ser. No. 09/629,957 filed Aug. 1, 2000 now U.S. Pat. No. 6,467,102, entitled "Transfer Seat with Extended Transfer Platform" which is hereby incorporated by reference.

Be it known that we, Glenn A. Peterson, a citizen of United States, residing at 105 Lee Court, Hendersonville, Tenn. 37075, and Michelle J. Jones, a citizen of United States, residing at 646 Albany Drive, Hermitage, Tenn. 37076; have invented a new and useful "Transfer Seat with Extended Transfer Platform."

BACKGROUND OF THE INVENTION

The present invention is concerned with devices for assisting bedridden or physically challenged people in moving and carrying out the necessary functions of daily living. More specifically, this invention pertains to transfer seats, such as commode seats, that are attached to conventional commodes, bedside commodes, shower chairs, and similar articles in order to allow a person to be easily transferred to such articles from a bed, wheelchair, or other piece of furniture.

People who are temporarily or permanently confined to beds or wheelchairs, or who have difficulty moving about their home or hospital room because of a disabling condition, often employ a portable bedside commode in order to permit bodily waste products to be expelled adjacent to the device or article of furniture upon which they are situated. This arrangement renders unnecessary the movement or transport of a confined patient to a commode in a bathroom, which may be difficult or even impossible in some situations to accomplish.

A conventional bedside commode is manufactured of lightweight tubular material in the form of a chair or seating device in that four leg or supporting members and a seat back are provided. In addition, support members function to bear a receptacle into which bodily wastes are deposited, a U-shaped seat not unlike that of conventional commodes, and a seat lid. The bedside commode is typically situated next to the device (bed or wheelchair) supporting the confined person. When it is necessary to use the commode, the confined person, either aided or unaided, is transferred from the bed or wheelchair to the seat of the commode without incident or difficulty. In certain situations, however, such a transfer can be achieved only with great difficulty because a sizable gap of space exists between the outer edge of the commode seat and the supporting device. In conventional designs, the commode seat is designed only to support a confined person during a seated position on the seat and thus occupies only a limited area in relation to the footprint or outer perimeter of the commode frame. When the frame of the bedside commode comes into contact with the frame of an adjacent bed or wheelchair, such a gap is formed between the commode seat and supporting surface of the bed or wheelchair.

A confined person who lacks the physical strength or agility to sit upright and transfer their body to the bedside commode either by sliding or standing and sitting may incur injury if he or she attempts to accomplish such a transfer over the gap between the supporting device and the bedside commode without the help of a medical assistant. Even if a medical assistant is available, such a transfer would be precarious if the confined person or patient is unusually heavy or bulky or if they are physically fragile, in which cases being lifted over the gap would be exceedingly difficult or pose the risk of injury.

Numerous designs for patient assistance devices have been provided in the prior art. Even though these designs may be suitable for the specific individual purposes to which they address, they are not suitable for the purposes of the present invention. For example, U.S. Pat. No. 4,719,655, Invalid Transfer Device, issued to Dean on Jan. 19, 1988, and U.S. Pat. No. 5,526,541, Patient Transfer Stand, issued to Massey et al. on Jun. 18, 1996, disclose devices that are designed primarily to lift or transfer invalids from a first supporting apparatus, such as a wheelchair, bed, commode, or sofa, to a second supporting apparatus.

U.S. Pat. No. 5,687,431, Toilet Transfer Device, issued to Garrett on Nov. 18, 1997, describes a toilet transfer bench designed for use with toilets in handicap stalls in order to facilitate the use of such toilets by persons in wheelchairs.

U.S. Pat. No. 5,373,591, Shower-Commode Chair and Transfer Track, issued to Myers on Dec. 20, 1994, and U.S. Pat. No. 5,822,809, Transfer Seat Apparatus, issued to Gallo on Oct. 20, 1998, illustrate devices that allow a confined or physically person to be transported to and positioned over a bathtub or commode without requiring the person to be lifted from a seat member of such designs.

As illustrated by the background art, efforts are continuously being made in an attempt to develop devices for assisting in the transfer of confined or physically challenged from a first location to a second location. No prior effort, however, provides the benefits attendant with the present invention.

As such, it may be appreciated that there is a continuing need for a new and improved bedside commode seat that is configured to eliminate the gap that extends between a conventional bedside commode and the bed or wheelchair from which the user must transfer to use the commode. In these respects, the present version of the invention substantially departs from the conventional concepts and designs of the prior art, and in so doing provides an apparatus that substantially fulfills this need. Additionally, the devices described in the prior patents and commercial techniques do not suggest the present inventive combination of component elements arranged and configured as disclosed herein.

Persons with disabilities also use other specialized support devices to assist them in the tasks of everyday living, including shower chairs and geri-chairs. Again, there is a lack of suitable devices available to provide for a safe and stable transfer of such persons from a bed or wheelchair to such specialized devices.

What is needed, then, to overcome the disadvantages of conventional bedside commodes and other specialized seating devices used by persons with disabilities, including the relatively limited supporting surface area of commode seats, is the provision of an extended commode seat that possesses side edges that project substantially beyond the footprint or perimeter of the commode frame in order to furnish a continuous supporting surface from the device or apparatus upon which the situated to bedside person is confined or commode. Such an extended seat would be adaptable to function with a variety of beside commodes and even with standard bathroom commodes, shower chairs, geri-chairs and the like.

Preferably, the improved commode seat would achieve its intended purposes, objects, and advantages with the use of a minimum number of functioning parts, at a reasonable cost to manufacture, and by employing only readily available materials.

SUMMARY OF THE INVENTION

The present invention overcomes the deficiencies associated with prior art bedside commode seats by providing an extended transfer platform that eliminates the inconvenient and dangerous gap that exists when the user is attempting to move from a bed or wheelchair to the commode. Described briefly, according to a typical embodiment, the invention presents an extended commode seat that consists of a flat, rectangular elongate member that is comprised of top and bottom sides, lateral sides extending from the seating portion of the seat to form an extended transfer platform, and front and rear side edges. The rear side edge of the seat is fitted with fasteners that allow the seat to be attached to the frame of a bedside commode seat in pivoting engagement. An aperture formed within the central seating portion of the seat is aligned over a commode receptacle when the seat is attached to the commode. The front side edge of the seat is partially formed with a lip that extends from the side edge for some distance, and the side edges are chamfered on the top side. The seat can be manufactured of a variety of lightweight, durable materials, such as wood, plastic, fiberglass, and the like.

When the seat is attached to a bedside commode, the seat can be adjusted to a lower, seating position at which the lower side of the extended transfer platform makes contact with the supporting frame of a bedside commode, and the aperture is aligned directly over the commode receptacle. The lateral sides of extend for some distance beyond the footprint or perimeter of the commode frame, thereby by providing a continuous extended transfer platform upon which a patient or confined person can traverse once the commode seat is positioned next to a support surface of a bed, wheelchair, etc. The seat can be raised upright upon the fasteners to allow access to the commode receptacle for cleaning and replacement.

In other embodiments of the invention, the seat with extended transfer platform is attached to a shower chair, geri-chair, rehab commode, conventional commode, or other support device used by a person needing assistance and support when transferring from an adjacent position.

The foregoing has outlined rather broadly some of the important features of the present invention in order that the detailed description of the invention that follows may be better understood so that the that present contribution to the art can be more fully appreciated. Additional features of the invention will be described below. It should be appreciated by those skilled in the art that the conception and the disclosed specific methods and structures may be readily utilized as a basis for modifying or designing other structures for carrying out the same purposes of the present invention, without departing from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways, including with wheel chairs, shower chairs, geri-chairs, rehab commodes, and even conventional commodes.

Accordingly, one object of the invention to provide a low-cost, easy-to-manufacture, and easy to-market commode seat having an extended transfer platform.

A further object of the invention is to provide an easy-to-use and versatile extended transfer seat for commodes, wheel chairs, shower chairs, and the like.

Another object of the invention is to provide an extended commode seat that can be used with conventional bedside commodes and standard bathroom commodes.

Yet another object of the invention is to provide an extended commode seat that is comprised partially of lateral sides that extend beyond the footprint or perimeter of the supporting frame of a conventional bedside commode in order to allow a continuous supporting transfer platform to be achieved once the commode is positioned next to a patient supporting device such as a bed or wheelchair.

DESCRIPTION OF THE PREFERRED EMBODIMENTS

Figure 1:
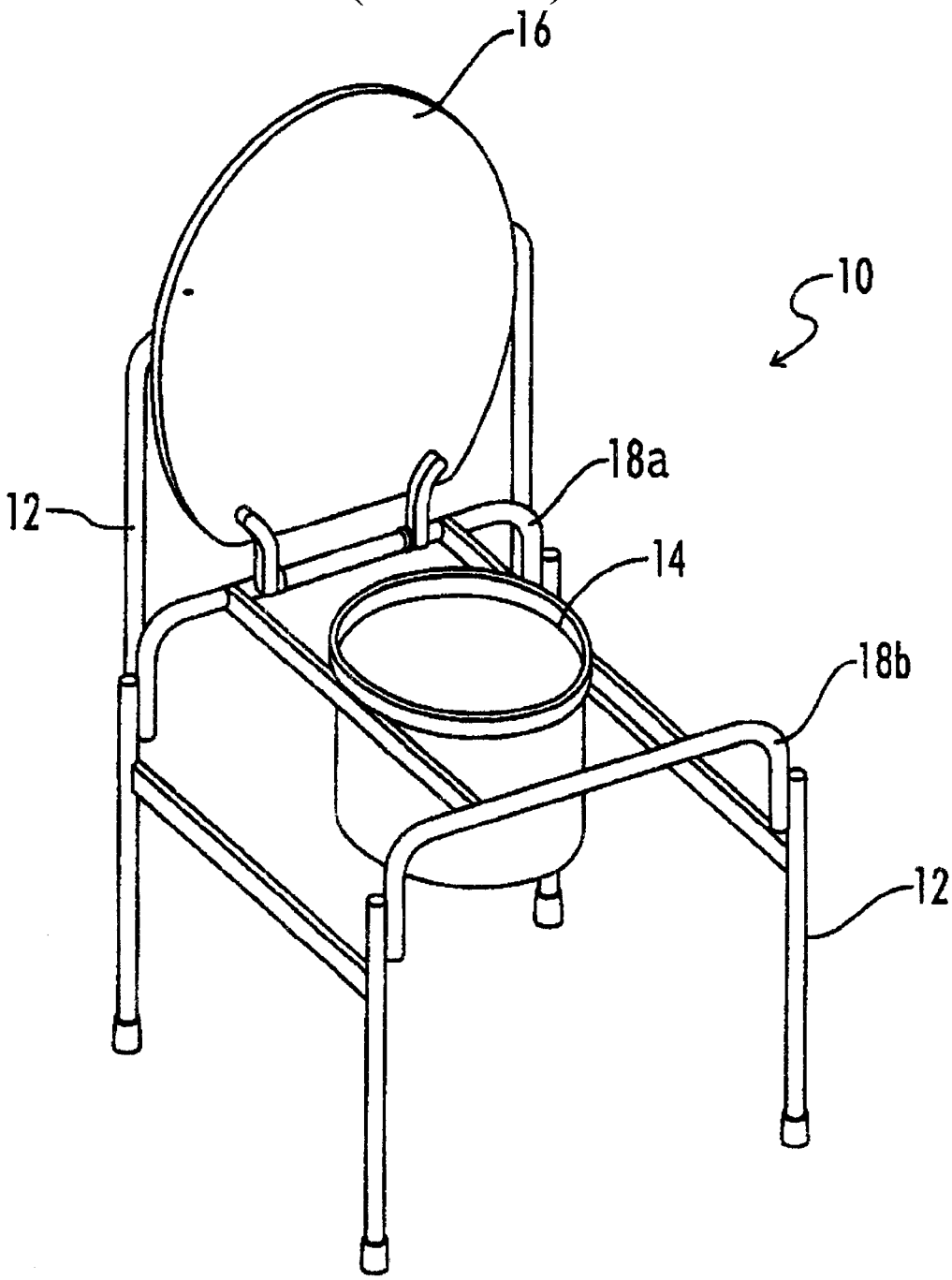
FIG. 1 is a perspective view of a conventional bedside commode with a conventional seat removed therefrom.

Referring now to the drawings and to FIG. 1 in particular, there is illustrated a conventional bedside commode 10, which is constructed generally of a lightweight tubular frame 12, waste receptacle 14, lid 16, and seat support members 18*a, b*. The bedside commode 10 is typically furnished with a conventional U-shaped seat that is pivotally attached to seat support member 18*a*. For purposes of this description, the commode 10 is illustrated without a conventional seat. Also, it will be apparent to those of skill in the art that the present invention is not limited to use with the commode seat of FIG. 1. Rather, the seat with extended transfer platform can be part of any one of a number of assisting and supporting devices where a user must transfer to the device from an adjacent bed of seat. For example, the commode seat of FIG. 1 could be provided with locking wheels such that it would function as a shower chair. Alternatively, the commode could be integral to a rehab commode chair that is provided with a wheelchair type mobility mechanism.

Figure 2:
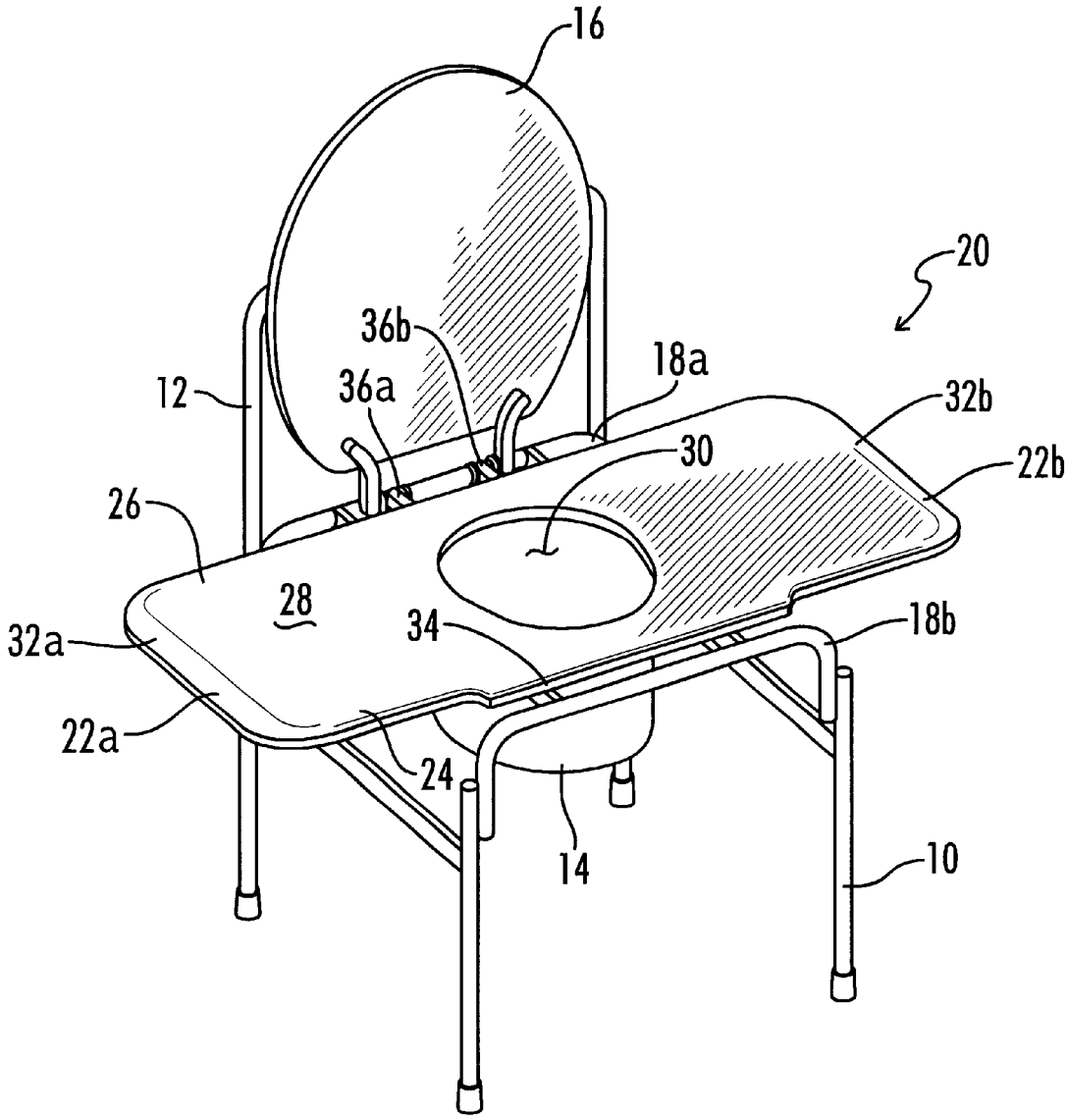
FIG. 2 is a perspective view of an extended commode seat in accordance with the present version of the invention attached to a conventional bedside commode.
Figure 3:
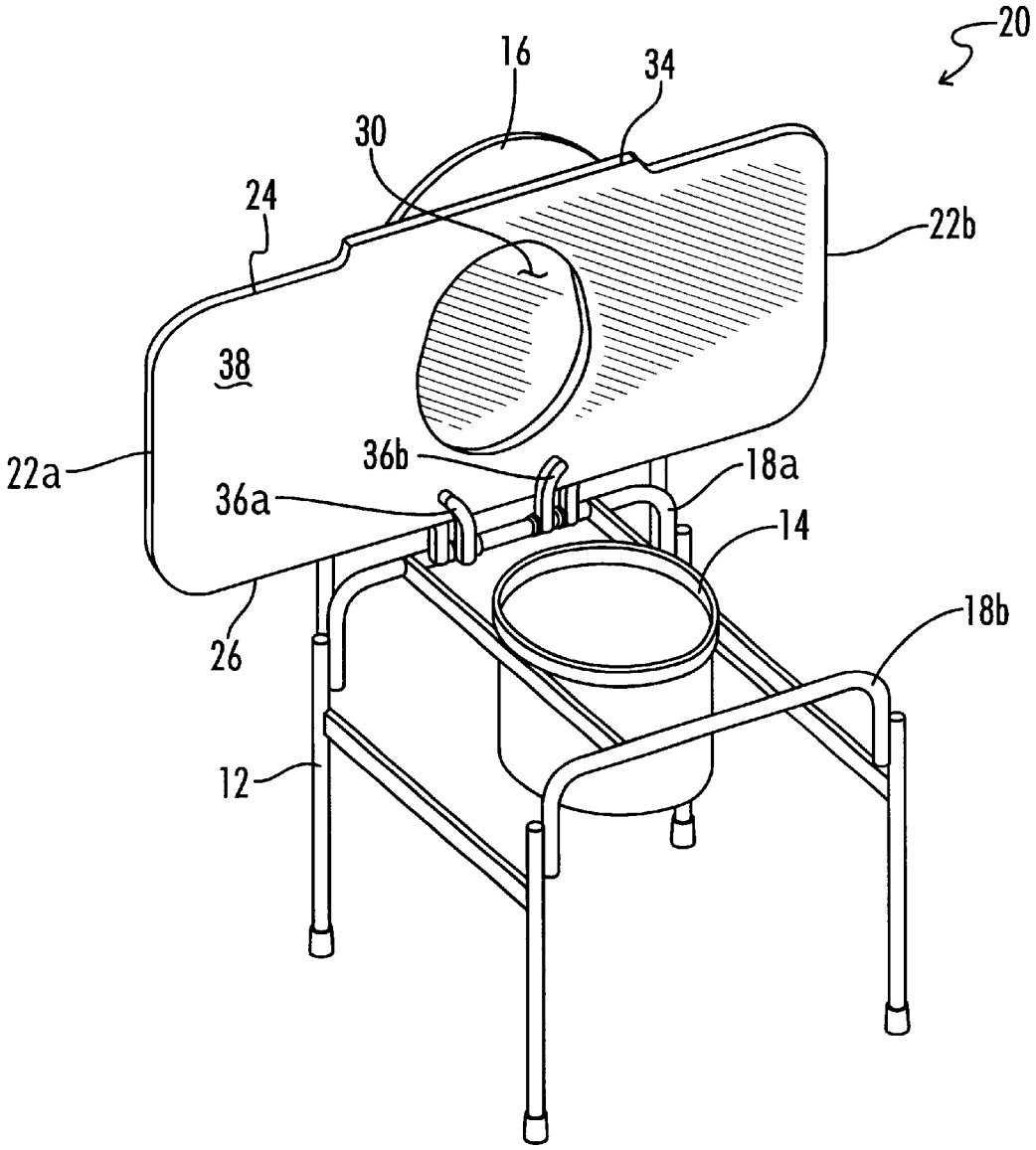
FIG. 3 is a perspective view of an extended commode seat in accordance with the present version of the invention raised upright to allow access to a receptacle of a conventional bedside commode.

Referring to FIG. 2, one embodiment of the present invention is shown, combining a conventional bedside commode 10 with a commode seat 20 having an extended transfer platform, the seat 20 being pivotally attached to the commode 10 at a seat support member 18*a*. The extended commode seat 20, displayed in the lowered or seating position, is preferably of a unitary construction configured into a flat, elongate, rectangular member that is manufactured of lightweight, durable, attractive material, such polished wood or wood products, plastic, fiberglass, and the like. In the embodiment as shown, the commode seat 20 includes two lateral sides 22*a, b* extending from a central seating portion, front side 24 edge, rear side 26 edge, top side 28, and bottom side 38 (FIG. 3). An ovoid aperture 30 is formed in the central seating portion of the seat 20 so that when the seat 20 is lowered as illustrated, the aperture 30 is aligned directly over the receptacle 14 in order to allow access to the interior of the receptacle 14. The lateral sides 22*a, b* form an extended transfer platform to facilitate a continuously supported transfer of the user from an adjacent bed or wheel chair to the seating portion of the seat 20 and back again. The selection of materials for seat 20 is conventional, with the seating portion of seat 20 being adapted to support a user in a seated position over the receptacle, and the extended transfer platform having sufficient strength to support the user during the transfer process to and from the adjacent bed, wheelchair, or the like.

The extended commode seat 20 is additionally constructed with rounded corners formed at the junction of any two sides or side edges and with chamfered edges 32*a, b* at the lateral sides 22*a, b* on the top side 28. The chamfered edges 32*a, b* present a slightly inclined surface at the outer margin of the transfer platform that assists in the transfer of a person onto or off the seat 20. A lip 34 extends partially from the front side 24 edge for some distance sufficient to provide a grasping surface of the seat directly over a seat support member 18*b*. Two fasteners 36*a, b* are attached at the rear side 26 edge of the seat 20 to the bottom side 38 thereof (FIG. 3). Thus, the seat 20 can be constructed as a portable device that is attachable and removable from one or more conventional commode chairs and the like.

Referring again to FIG. 2, the lateral sides 22*a, b* forming the extended transfer platform extend for some distance beyond the seat support members 18*a, b* and the footprint and perimeter of the frame 12 in order to allow either side 22*a, b* to at least partially overlap and preferably make contact with the support surface of a bed or wheelchair when the commode 10 with the seat 20 attached is positioned for use next to the bed or wheelchair. In this manner, a continuous, uninterrupted transfer and support platform extending from the bed or wheelchair to the seating portion of the seat 20, including aperture 30, is achieved. The transition from the supporting surface of the bed or wheelchair to the seat 20 is facilitated by the rounded corners and chamfered edges 32*a, b* of the seat 20.

As necessary, the seat can be raised upright as displayed in FIG. 3 upon the fasteners 36*a, b* in order to allow direct access to the receptacle 14 for cleaning, emptying, and replacement.

Figure 4:
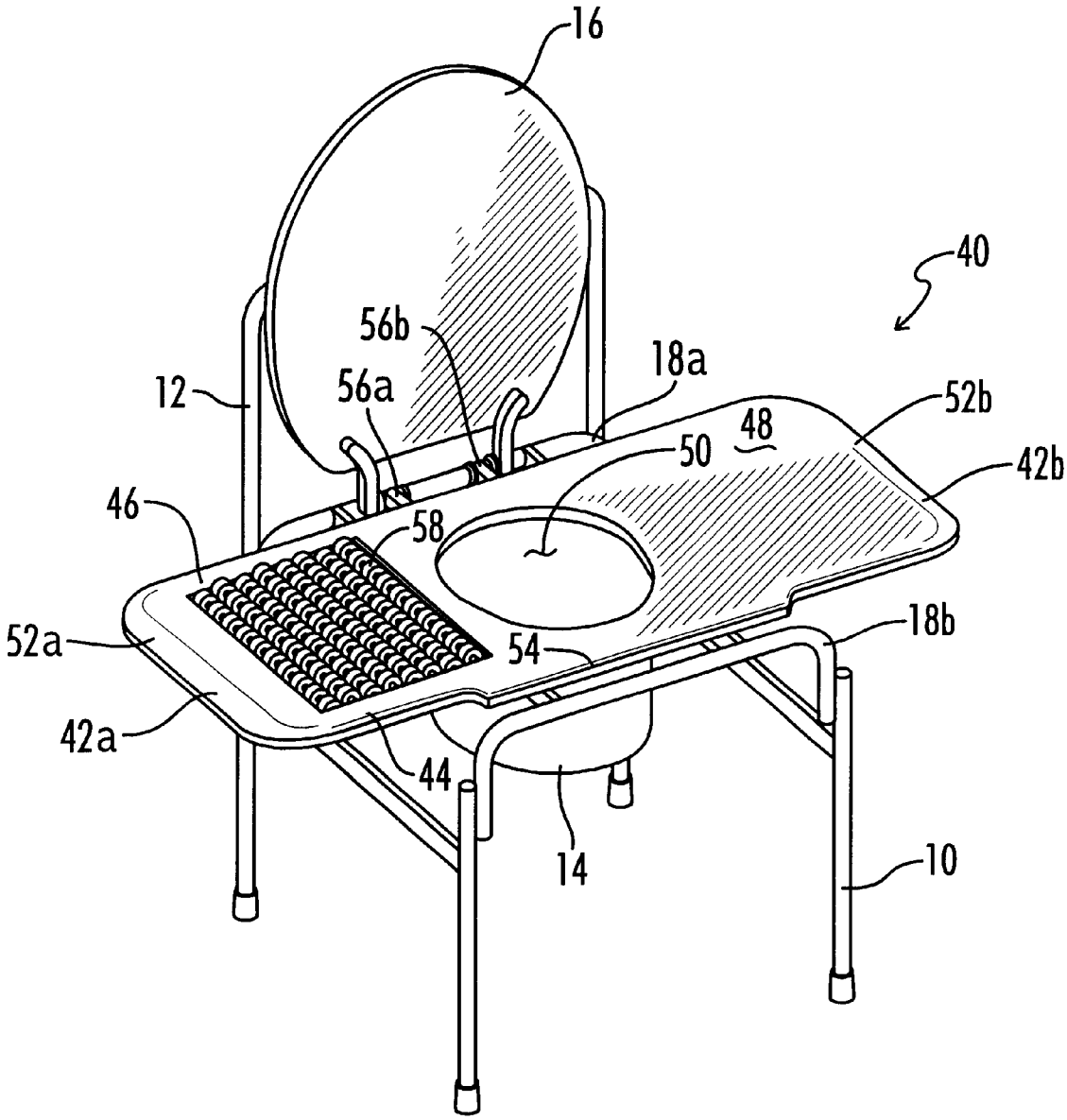
FIG. 4 is a perspective view of an alternate embodiment of an extended commode seat in accordance with the present version of the invention.

In FIG. 4, a second embodiment of the extended commode seat 40 is displayed attached to a conventional bedside commode 10. This embodiment 40 is generally constructed as the first embodiment 20, configured into a flat, elongate, rectangular shape with lateral sides 42*a, b,* front side 44 edge, edge, rear side 46, edge, top side 48, aperture 50, chamfered sides 52*a, b,* rounded corners, and front lip 54. The seat 38 is pivotally attached to the commode 10 with appropriate fasteners 56*a, b*. In this embodiment, one portion of the seat 40 between the aperture 50 and a lateral side 42*a* is formed with a rectangular opening. A roller assembly 58 or apparatus, which is attached to the perimeter side walls of the aperture, is comprised of elongate tubular axles or rods onto which circular specificities, these should not be construed as limitation on the scope of the version of the invention, but rather as an exemplification of the preferred embodiments thereof.

Figure 6A:
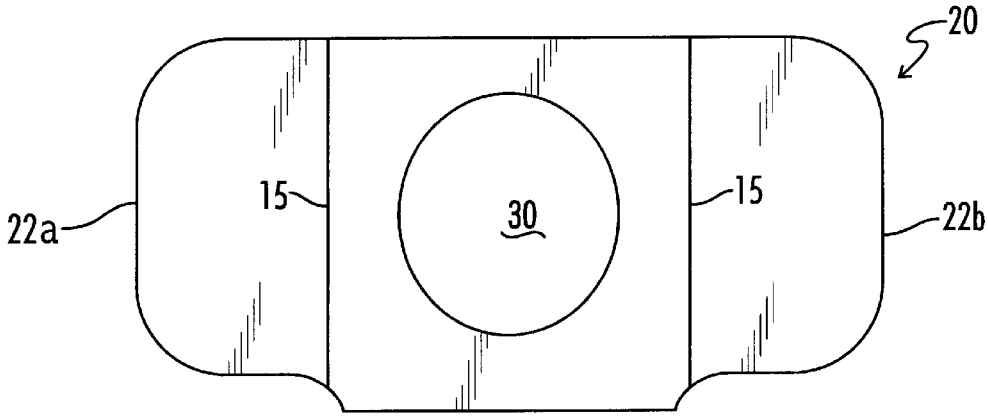
FIG. 6*a* is a plan view of a further embodiment of the extended commode seat in which the extended transfer platforms are hinged to the seating portion.
Figure 6B:
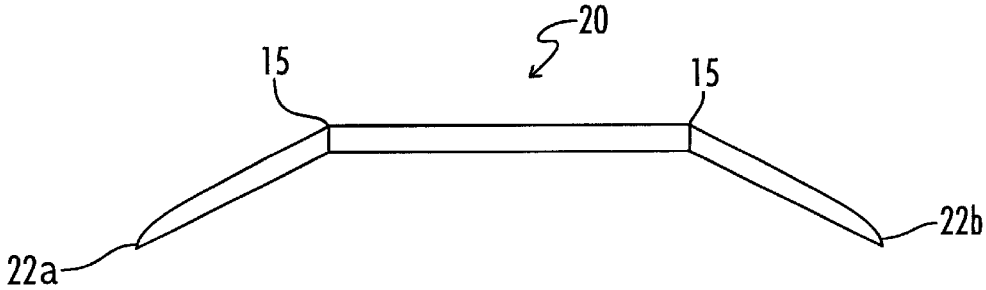
FIG. 6*b* is a front view of the commode seat of FIG. 6*a*.

FIGS. 6*a* and 6*b* show another embodiment of the invention in which the extended transfer platform (lateral sides 22*a*, b) is attached to the seating portion of the seat 10 by use of conventional hinges 15.

Figure 5:
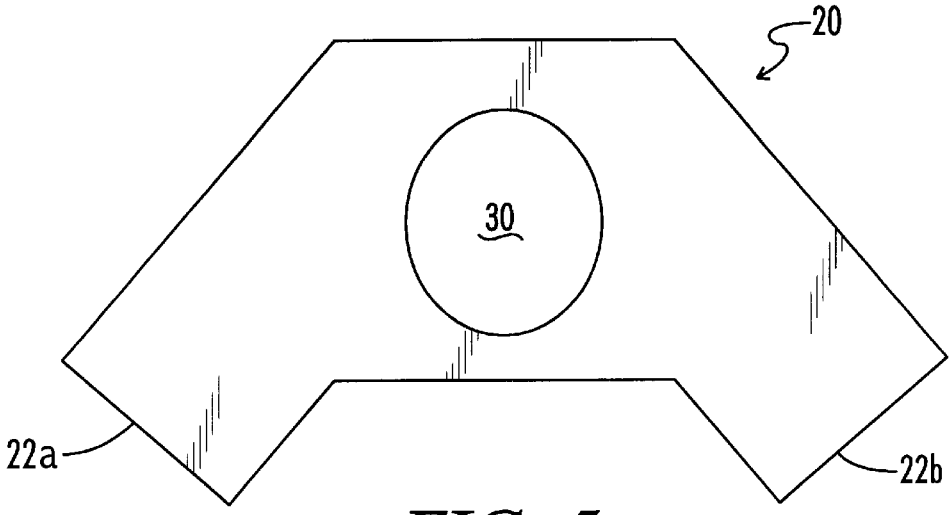
FIG. 5 is a plan view of another embodiment of the extended commode seat having angled bilateral extended transfer platforms.

FIG. 5 is a plan view of yet another embodiment of the invention showing the lateral sides 22*a, b* extending at an angle away from the seating portion. In some applications, the angled configuration of FIG. 5 can improve the ability of the user to properly position the commode, etc. proximate to the other seating article.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of numerous changes in the details of construction and combination and arrangement of parts may be resorted to without departing form the spirit and scope of the invention.

While this version of the invention has been illustrated and described in detail in the drawings and foregoing description, the same is to be considered as illustrative and not restrictive in character, it being understood that only the preferred embodiments have been shown and described and that all changes and modifications that come within the spirit of the version of the invention are desired to be protected. For instance, additional embodiments are possible and remain within the spirit and scope of this version of the invention, such as commode seats that extend to only one side (left or right), and seats that employ angled extensions. A support leg or other structural member can be added to provide additional strength. The seat having an extended transfer platform can combined with a different chair-like devices used by disabled persons, including a shower chair, rehab commode, geri-chair, wheel chair, a conventional commode, or any other similar device where a stable and continuous transfer surface is needed to assist a disabled person in moving onto the seat.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

From the foregoing, it will be understood by persons skilled in the art that an improved transfer seat has been provided that extends beyond the footprint or perimeter of the supporting frame of a conventional bedside commode. The invention is relatively simple and easy to manufacture, yet affords a variety of uses. While the description contains many details of several embodiments of the invention, these should not be construed as limitations on the scope of the version of the invention, but rather as an exemplification of the preferred embodiments thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

Thus, although there have been described particular embodiments of the present invention of a new and useful Transfer Seat with Extended Transfer Platform, it is not intended that such references be construed as limitations upon the scope of this invention except as set forth in the following claims.

What is claimed is:

1. A commode seat for facilitating the transfer of a physically disabled user from a support device such as a bed or wheelchair to a commode having a frame when a perimeter member of the commode frame is positioned proximate to a supporting surface of the support device, the commode seat comprising:

a. a seating portion removably attachable to the commode and adapted to support the user in a seated position when using the commode, the seating portion having an opening positioned over a receptacle in the commode when the commode seat is supported on the frame of the commode; and b. a transfer platform attached to and extending laterally outward from the seating portion and beyond the perimeter member of the commode frame for a distance sufficient to allow the transfer platform to at least partially overlap the supporting surface of the support device to define a substantially planar and continuous user transfer surface adapted to bridge between and be supported only by the commode and the support device, the transfer surface further adapted to allow the user to sit directly on and slide along the transfer surface continuously from the support device to the seating portion.

2. The commode seat of claim 1 wherein the transfer platform extends bilaterally from the seating portion.

3. The commode seat of claim 1 wherein the transfer platform is attached to the seating portion of the seat by a hinge so that the transform platform can be moved into a folded position.

4. The commode seat of claim 1 wherein the seating portion and the transfer platform form a continuous planar surface of unitary rigid construction.

5. The commode seat of claim 1 wherein the transfer platform extends unilaterally from the seating portion.

6. The commode seat of either claim 3 or claim 4 wherein at least a portion of the transfer platform extends outwardly at an angle with respect to the seating portion.

7. A combination of a seat attached to a chair-like device for use by a disabled person for carrying out one or more tasks of daily living, the chair-like device having a supporting frame member that is positioned proximate to an adjacent device that is supporting the disabled person, the combination further comprising a transfer platform that is integral to and extends from a central portion of the seat and beyond the supporting frame member to provide a continuous, substantially planar supporting transfer surface from the chair-like device to the adjacent device, the supporting transfer platform adapted to be bridged between and supported by only the chair-like device and the adjacent device, the transfer surface further adapted to allow the user to sit directly on and slide along the transfer surface continuously from the chair-like device to the adjacent device.

8. The combination of claim 7 wherein the chair-like device comprises a commode and the seat further comprises an opening in a seating portion of the seat.

9. The combination of claim 8 wherein the commode is a bedside commode.

10. The combination of claim 7 wherein the chair-like device comprises a shower chair.

11. A combination of a seat and a chair-like device intended to support a disabled person, the combination further comprising the seat attached to the chair-like device, the seat having a central seating portion integrally joined to a laterally extending transfer platform, the transfer platform including a planar section extending beyond a perimeter supporting frame member of the chair-like device and to a point adapted to overlap a supporting member of an adjacent bed or chair from which the disabled person must transfer to the chair-like device and seat, the central seating portion and extended transfer platform defining a continuous substantially planar transfer surface adapted to bridge between and be supported only by the adjacent bed or chair and the chair like device, the transfer surface further adapted to allow the user to sit directly on and slide continuously along the transfer surface.

12. The combination of claim 11 wherein the transfer platform comprises at least one lateral side having a chamfered edge providing a slightly inclined surface at an outer margin of the platform.

13. The combination of claim 11 further comprising an opening in the seating portion of the seat positioned over a commode receptacle in the chair like device.

14. The combination of claim 11 wherein the transform platform further comprises an integral roller assembly positioned to facilitate movement of the disabled person along the surface of the transform platform.

15. The combination of claim 11 wherein the transform platform extends unilaterally from the seating portion.

* * * * *